United States Patent [19]

Randall

[11] Patent Number: 5,070,371

[45] Date of Patent: Dec. 3, 1991

[54] METHOD AND APPARATUS FOR HANDLING TONER IMAGES

[75] Inventor: Kent A. Randall, Webster, N.Y.

[73] Assignee: Eastman Kodak Company, Rochester, N.Y.

[21] Appl. No.: 601,539

[22] Filed: Oct. 22, 1990

[51] Int. Cl.[5] ..... G03G 15/14; G03G 15/01

[52] U.S. Cl. ..... 355/272; 355/271; 355/277; 355/319; 355/326; 355/328; 355/24; 355/244

[58] Field of Search ..... 355/271, 272-274, 355/277, 281, 244, 326-328, 23, 24, 26, 90, 319

[56] References Cited

U.S. PATENT DOCUMENTS

| | | | |
|---|---|---|---|
| 3,940,210 | 2/1976 | Donohue | 355/24 X |
| 4,191,465 | 3/1980 | Boase et al. . | |
| 4,194,829 | 3/1980 | Cavagnaro . | |
| 4,251,154 | 2/1981 | Russel | 355/326 |
| 4,428,662 | 1/1984 | Day | 355/271 X |
| 4,688,925 | 8/1987 | Randall . | |
| 4,714,939 | 12/1987 | Ahern et al. . | |

OTHER PUBLICATIONS

*Xerox Disclosure Journal*, vol. 9, No. 1, Jan./Feb. 1984, Andrews, Ronald A., "Single Pass Duplex in Electronic Systems".

*Primary Examiner*—A. T. Grimley
*Assistant Examiner*—Matthew S. Smith
*Attorney, Agent, or Firm*—Leonard W. Treash, Jr.

[57] ABSTRACT

Duplex toner images are created on a receiving sheet by forming first and second toner images on an image member. The first toner image is transferred to a first intermediate member and then to a second intermediate member. The second toner image is transferred to a first side of the receiving sheet. The receiving sheet is separated from the image member and the first toner image is transferred to the other side of the receiving sheet from the second intermediate member. With this apparatus, a straight paper path can be provided without reversing optics or electronics for forming one of the two toner images. Two toner images can also be combined into a single image on the second intermediate member, for example, two toner images of different color, and a third toner image placed on the first side of the sheet.

15 Claims, 3 Drawing Sheets

METHOD AND APPARATUS FOR HANDLING TONER IMAGES

RELATED APPLICATIONS

This application is related to co-assigned: U.S. patent application Ser. No. 07/601,630, filed Oct. 22, 1990, MULTIPURPOSE IMAGING APPARATUS, in the name of Kent A. Randall.

U.S. patent application Ser. No. 07/601,538, filed Oct. 22, 1990, IMAGING APPARATUS UTILIZING INTERMEDIATE TRANSFER MEMBER, in the name of Kent A. Randall.

U.S. patent application Ser. No. 07/601,629, filed Oct. 22, 1990, A METHOD AND APPARATUS FOR FORMING COMBINED TONER IMAGES, in the name of Kent A. Randall.

TECHNICAL FIELD

This invention relates to toner images, for example, those created by electrophotography. More specifically, it relates to methods of forming toner images on receiving sheets using one or more intermediate transfer members. It has particular utility in forming duplex toner images on a receiving sheet.

BACKGROUND ART

Conventional electrophotographic copying and printing forms duplex copies or prints in one or two ways. The large majority place a toner image on one side of a sheet of paper, fuse the image, and then recirculate the paper back through the system to receive a second toner image on the opposite side which is also fused along with further fusing of the first toner image. Some of the most difficult paper handling problems associated with modern copiers and printers occur in the substantial additional handling associated with this approach. Further, one toner image receives substantially more fusing than the other which restricts the materials usable in the system.

In the second approach, two transfer stations are used in tandem with the receiving sheet first receiving a toner image at one transfer station then being immediately turned over and fed to the second transfer station to take the second toner image. The receiving sheet carrying both toner images is then fed to a duplex fuser where the toner images are fused simultaneously. This approach, called "single-pass duplexing", is shown in a number of references, for example, U.S. Pat. No. 4,191,465, issued Mar. 4, 1980, to Boase et al and U.S. Pat. No. 4,194,829, issued Mar. 25, 1980, to Cavagnaro.

U.S. Pat. No. 4,714,939, issued Dec. 22, 1987 to D. K. Ahern et al, is one of a number of references which show the use of an intermediate transfer member to form duplex toner images on a receiving sheet. According to that patent, consecutive toner images are created electrophotographically on a photoconductive image member. The first toner image is transferred to an intermediate member, which can be a roller or an endless belt. A receiving sheet is fed between the photoconductive image member and the intermediate member and the first image is transferred to one side of the sheet and the second image is transferred to the other side of the sheet.

This system can also be used to create color images by transferring two or more images in registration to the intermediate with the combination being transferred back to the first side of the sheet.

These systems have the great advantage of a straight relatively short path for the receiving sheet from its supply to the fuser. Unfortunately, one image is transferred one more time than the other image. This forces a change in the exposure station between images. The most common approach to solving this problem is to add an extra mirror in the optical path for only one of the two exposures.

U.S. Pat. No. 4,688,925, issued Aug. 25, 1987 to R. A. Randall, shows a system with two intermediates in which a first image is transferred to one intermediate and a second image to the second. A receiving sheet is fed between the intermediates to receive the images on opposite sides. This cures the problem of reversing optics but requires two articulating intermediates.

DISCLOSURE OF THE INVENTION

It is an object of the invention to provide a method and apparatus for forming multiple toner images on the same receiving sheet using an intermediate member, but without requiring image reversal of one image, or requiring two articulating intermediates to do duplex.

These and other objects are accomplished by forming first and second toner images on an image member as in the prior art. The first image is transferred to a first intermediate member and then to a second intermediate member. From the second intermediate member it is transferred to one side of the receiving sheet and the second toner image is transferred to the other side of the receiving sheet directly from the image member to create duplex toner images on the receiving sheet, but without the need for reversing one of the original toner images on the image member.

According to a preferred embodiment, the image member is an endless belt which is entrained around a series of rollers. One of the rollers is a relatively small roller which creates a substantially sharp turn in the belt. A receiving sheet will not follow the belt around the small roller and is separated therefrom. The receiving sheet is picked up by a transport member which also is the second intermediate member. While the transport member is transporting the receiving sheet to a fuser or other fixing device, the first toner image is transferred to the first side of the receiving sheet.

According to another preferred embodiment, more than one toner image can be superimposed on the second intermediate member, thereby conveniently providing either highlight color, or even full color on one side of the receiving sheet. A single color image can be formed on the other side with a third toner image transferred directly from the image member.

The invention provides duplex copying or printing with a straight paper path and without the need for reversing optics in forming every other image. In its preferred form, one of intermediate members also performs the function of transporting the receiving sheet from the original image member to a fuser, a function presently performed by a transport device of substantial complexity and cost.

BRIEF DESCRIPTION OF THE DRAWINGS

In the detailed description of the preferred embodiment of the invention presented below, reference is made to the accompanying drawings, in which.

BEST MODE OF CARRYING OUT THE INVENTION

Figure 1:
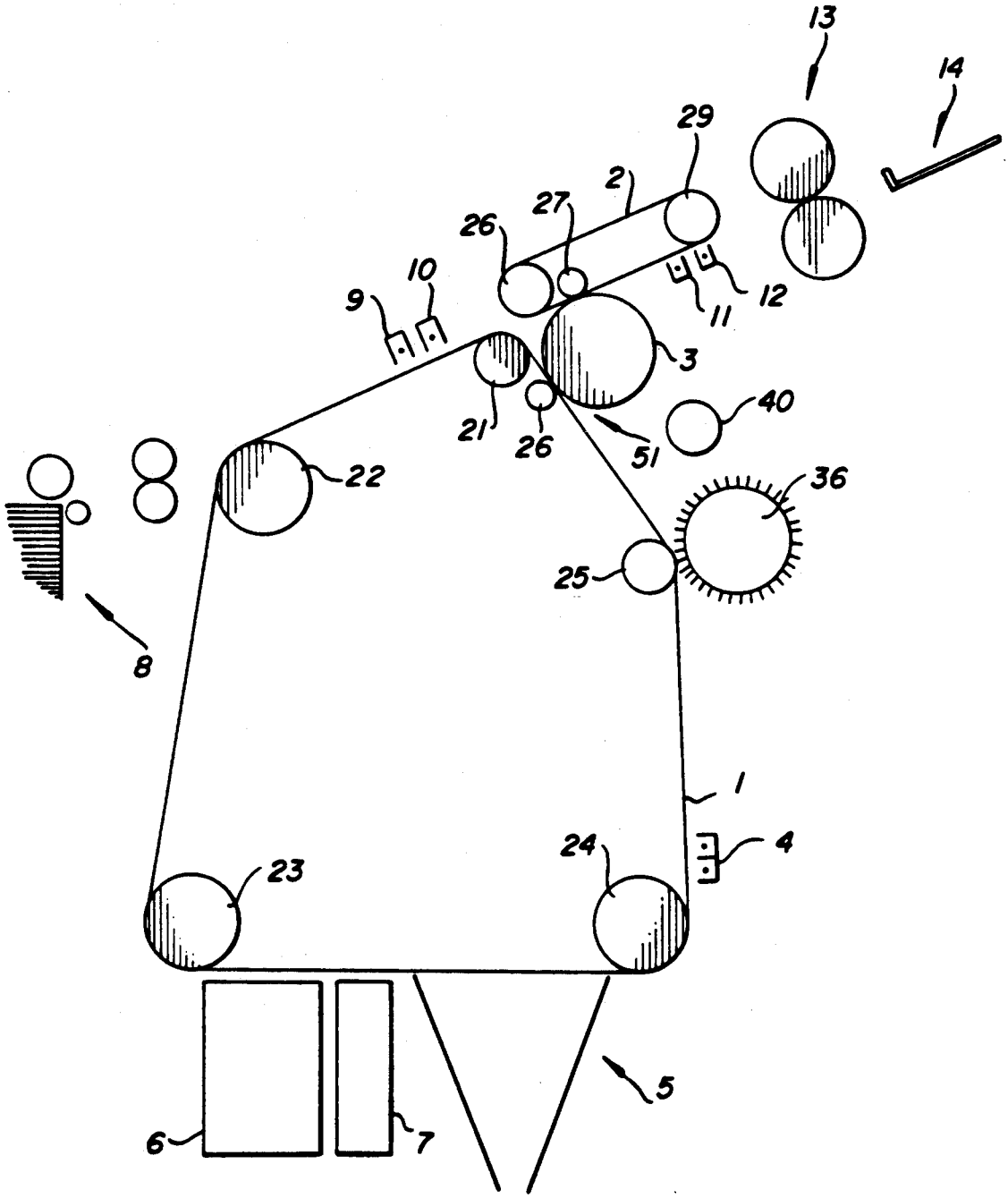
FIG. 1 is a side schematic of a copier illustrating an embodiment of the invention.

Aside from the portion also shown in FIGS. 2-5, the copier illustrated in FIG. 1 is conventional. According to FIG. 1, an image member, for example, photoconductive belt 1 is entrained around a series of rollers 21, 22, 23, 24, 25 and 26, and driven past a series of electrophotographic stations well-known in the art. Image member 1 is uniformly charged at a charging station 4 and imagewise exposed at an optical exposure station 5 to create an electrostatic image, which electrostatic image can be toned by either of toning stations 6 or 7. As illustrated in FIG. 1, toning station 6 contains black toner and would be the toner station used for most copying. Toner station 7 contains a different colored toner, for example, red or blue. It could be used to create single-color images or by means which we will describe later can be combined with black toner images to create two-color combined images. Each image is toned by one of toner stations 6 and 7 to create a toner image.

In doing simplex copies, a receiving sheet is fed from a sheet supply 8 into contact with image member 1 at a transfer station 9 where a toner image is transferred to the bottom side of the sheet using a conventional corona transfer 9. A separation corona 10 prepares the sheet for separation as the image member 1 goes around roller 21.

Roller 21 is a small roller, for example, 1-inch in diameter. As image member 1 sharply changes direction going around roller 21 the receiving sheet has a tendency to go straight and separate from the image member.

The process at this point is conventional and has been used commercially for 15 years. In simplex copying, the receiving sheet is attracted to a sheet transport device which holds the upper surface of the receiving sheet while transporting it to a duplex fuser 13. The sheet transport device in FIG. 1, however, is a second intermediate member 2 which performs multiple functions in doing duplex or color, which will be explained below. After passing through the fuser 13, the receiving sheet is deposited in an output tray 14.

Figure 2:
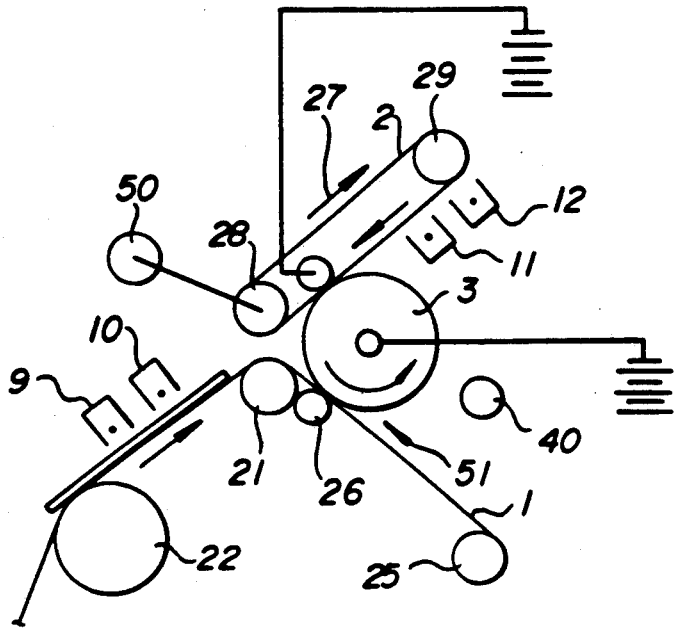
FIGS. 2 and 3 are side schematics of the transfer and sheet transport portions of the apparatus shown in FIG. 1 illustrating two different steps in its operation
Figure 3:
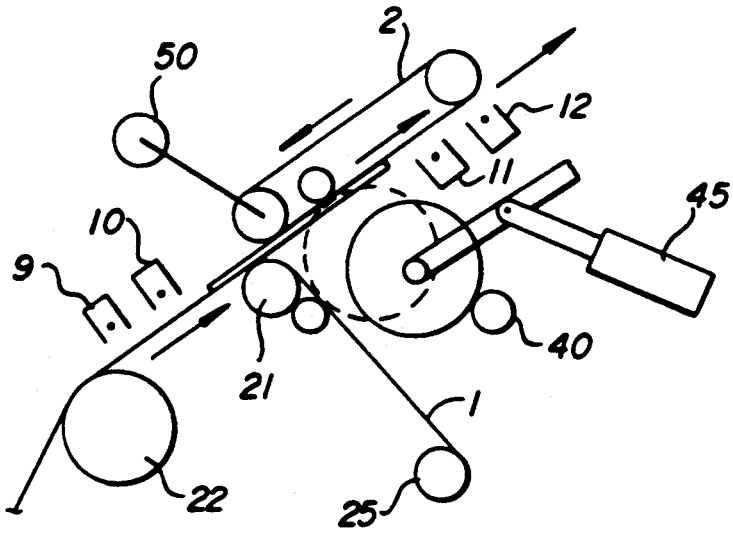

Operation of the apparatus shown in FIG. 1 in a duplex mode can be best understood by reference to FIGS. 2 and 3. In duplex, the images to be formed on opposite sides of a receiving sheet are formed as consecutive images on image member 1 in the same manner that the single toner image was formed in simplex. Preferably, they are formed on consecutive image frames.

According to FIG. 2, the first toner image passes under the transfer station 9 and separation corona 10 with those stations turned off. It follows image member 1 around separation roller 21 and is transferred to a first intermediate member, for example, roller 3 at a transfer station 51. Such transfer is effected by conventional electrostatic roller transfer. Assuming that photoconductor 1 has a conductive backing that is maintained at ground, first intermediate member 3 is biased to a polarity opposite to that of the toner image to attract the toner image thereto. The toner image on the first intermediate member 3 is "right-reading". That is, it can be directly read without the aid of a mirror.

As first intermediate member or roller 3 rotates in a counterclockwise direction, it comes into transfer relation with second intermediate member 2 which was also the sheet transport mechanism for transporting a receiving sheet to the fuser 13 (FIG. 1). Because member 3 is rotating in a counterclockwise direction, second intermediate member 2 must be moving in a direction opposite that it was moving in FIG. 1. Second intermediate member 2 is an endless belt entrained around small rollers 28 and 29 and driven by a reversible motor 50 (FIG. 2).

As shown in FIG. 2, second intermediate transfer member 2 is driven in a clockwise direction as it receives the first toner image from first intermediate member 3. To transfer the toner image this second time, there will again need to be a difference in electrostatic potential between the first and second intermediate members 2 and 3. This can be accomplished by making intermediate member 2 at a still higher bias attractive to toner than is transfer member 3 or by isolating the two transfers so that first intermediate member 3 can be at a high potential for the first transfer from image member 1 and at a low potential for the second transfer to second image member 2. Both of these approaches are known in the art.

The first toner image is now reverse reading on intermediate member 2 as is the second toner image following immediately thereafter on image member 1.

According to FIG. 2 a receiving sheet has been fed into the first transfer station with both transfer corona 9 and separation corona 10 turned on to transfer the second toner image to the bottom-side of the receiving sheet. As shown in FIG. 3, as the receiving sheet approaches separation roller 21, reversing motor 50 changes its direction and drives second intermediate member 2 in a counterclockwise direction. Second intermediate member 2 picks up the leading edge of the receiving sheet as it separates from image member 1 and transports the receiving sheet to the fuser 13. During such transport, the first toner image is transferred to the topside of the receiving sheet by a transfer corona 11. A separation corona 12 assists in separating the receiving sheet from the second intermediate member 2 for movement to the fuser 13. The second intermediate member 2 thus performs the function both of a second intermediate member and of a sheet transport device. Both images are fused simultaneously by duplex fuser 13.

As shown in FIG. 3, the first intermediate member, roller 3, is moved out of contact with both image member 1 and second intermediate member 2 by an articulation mechanism 45, while the first toner image is being transferred to the topside of the receiving sheet and the receiving sheet is being transported to the fuser. During this time, the first intermediate member can be cleaned by a roller cleaning device 40.

Alternatively, the intermediate member 3 can remain in contact with web 1 although moving out of contact with member 2. While in this condition, it can partially clean member 1 of residual toner left from the transfer of the second toner image. The residual toner would then be cleaned off member 3 by cleaning roller 40. Conventionally, and preferably, cleaning of the image member 1 is done by a cleaning station 36, shown in FIG. 1.

Intermediate members 3 and 2 can also be used to combine two images on a single side of a receiving sheet. In this mode of operation, consecutive toner images are transferred from image member 1 to intermediate member 3 and then to intermediate member 2. If intermediate member 2 is made of a length equal to a single frame, consecutive images will be superimposed on each other. They are then transferred as a combined image to the top of the receiving sheet by transfer corona 11 when the direction of intermediate member 2 is reversed, as in the primary mode.

This mode is effective for making two-color images on one side of a receiving sheet. The bottom-side of the receiving sheet can also receive a third image. Present high volume copiers that combine images do so by recirculating the sheet for the second or subsequent images. The approach shown in FIG. 1 generally provides more accurate registration of the two images and still only a single pass through fuser 13. The image combining approach can be used to combine two images of the same color or combine images made by toners from each of stations 6 and 7, making a two-color image.

Figure 4:
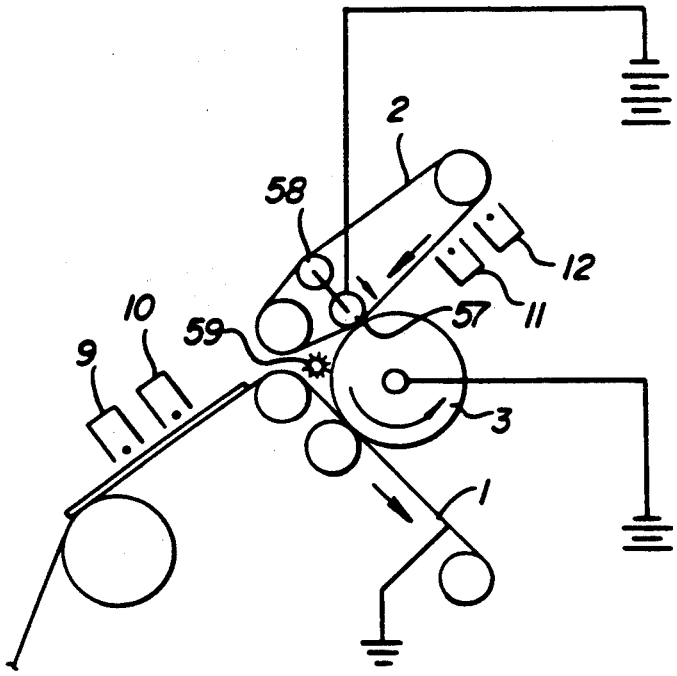
FIGS. 4 and 5 are side schematics similar to FIGS. 2 and 3 of an alternative embodiment of the invention.
Figure 5:
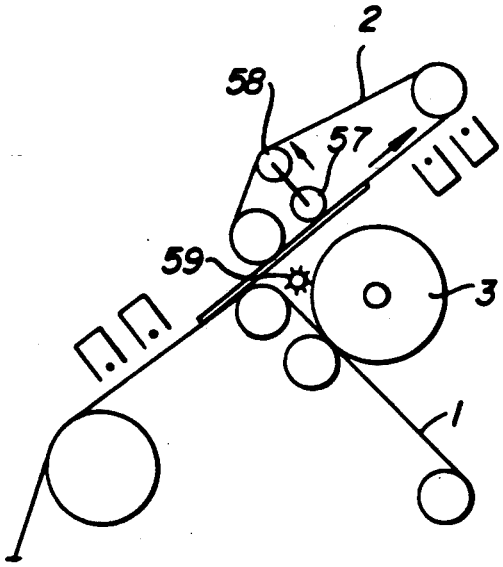

FIGS. 4 and 5 illustrate an alternative embodiment of the invention in which intermediate member 3 does not have to be articulated, but instead, has a fixed axis. In this embodiment, linked rollers or bars 57 and 58 are movable to change the endless path of the second intermediate member 2. As shown in FIG. 4, rollers or bars 57 and 58 move member 2 into contact with drum 3 to transfer the first toner image to member 2 from intermediate member 3. Rollers or bars 57 and 58 are then movable away from intermediate member 3 (as shown in FIG. 5) to allow enough separation between intermediate members 2 and 3 to permit a sheet to be transported to the fuser while receiving the first toner image on its topside. This allows intermediate member 3 to be permanently mounted in one position in the apparatus. A cleaning device 57 also does not have to be articulated.

Thus, the invention provides a straight receiving sheet path in doing duplex and/or image combining without reversing optics (or reversing electronics) for one of the images. It uses two intermediate members, one of which also serves as a paper transport in simplex as well as duplex modes to transport the receiving sheet to the fuser. One of the intermediate members need not be articulated.

The invention has been described in detail with particular reference to a preferred embodiment thereof, but it will be understood that variations and modifications can be effected within the spirit and scope of the invention as described hereinabove and as defined in the appended claims.

I claim:

1. Apparatus for forming duplex toner images on a receiving sheet, said apparatus comprising:

means for forming first and second toner images on an image member, means for transferring said first toner image from said image member to a first intermediate member, means for transferring said first toner image from said first intermediate member to a second intermediate member, means for transferring said second toner image from said image member to a first side of a receiving sheet, and means for transferring said first toner image from said second intermediate member to the other side of said receiving sheet to create duplex toner images on said receiving sheet.

2. Apparatus according to claim 1 wherein said second intermediate member is an endless belt and is positioned to transport said receiving sheet away from said image member.

3. Apparatus according to claim 2 further including means to fix both toner images to said receiving sheet simultaneously and wherein said second intermediate member is positioned to transport said receiving sheet from said image member to said fixing means.

4. Apparatus according to claim 1 which apparatus has an alternative mode of operation in which said first and second toner images to said first intermediate member and said means for transferring said first toner image to said second intermediate member is also adapted to transfer said first and second toner images to said second intermediate member to be superimposed on said second intermediate member creating a combined image formed of said first and second toner images, and said means for transferring said first and second toner images to the other side is adapted to transfer said combined image to said other side of said receiving sheet.

5. Apparatus according to claim 4 wherein, in said alternative mode said means for forming toner images is adapted to form, a third toner image on said image member, and said means for transferring to a first side of a receiving sheet is also adapted to transfer said third toner image to the first side of said receiving sheet thereby creating a receiving sheet having a single toner image on one side and a combined toner image on the other side.

6. Apparatus according to claim 4 wherein, in said alternative mode, said first and second toner images are of different color.

7. Apparatus according to claim 5 wherein, in said alternative mode, said first and second toner images are of different color.

8. Apparatus for forming duplex toner images on a receiving sheet, said apparatus comprising:

an endless belt image member entrained about a series of rollers, at least one of said rollers being sufficiently small that a receiving sheet transported by said belt with a first side contacting said belt has a tendency not to follow said belt around said roller, an endless belt transport device positioned to attract the opposite side of such a receiving sheet as said endless belt image member passes around said small roller, means for forming first and second toner images on said endless belt image member, means for transferring said first toner image from said image member to a first intermediate member, means for transferring said first toner image from said first intermediate member to said endless belt transport device, means for transferring said second toner image to a first side of a receiving sheet, and means for transferring said first toner image from said endless belt transport device to the other side of said receiving sheet as said endless belt transport device moves said receiving sheet away from said image member to create duplex toner images on said receiving sheet.

9. Apparatus according to claim 8 wherein said first intermediate member is an intermediate roller which is positioned to contact both said image member and said transport device to receive said first image from said image member and transfer it to said transport device.

10. Apparatus according to claim 9 including means for separating said intermediate roller and said endless belt transport device while said first toner image is being transferred to said receiving sheet.

11. Apparatus according to claim 10 wherein said endless belt transport device moves through an endless path, the axis of said intermediate roller is fixed, and said means for separating said intermediate roller and said transort device includes means for changing said endless path between a position in which said endless belt transport device contacts said roller and a position in which it does not contact said roller.

12. Apparatus according to claim 9 wherein said endless belt transport device includes means for driving said endless belt transport device in a first direction to move receiving sheets away from said image member and in a second direction opposite to said first direction to receive toner images from said intermediate roller.

13. Apparatus according to claim 8 wherein said endless belt image member approaches said small roller in a given direction and said transport device moves said receiving sheet essentially in said same direction.

14. Apparatus according to claim 8 further including means to fix both toner images to said receiving sheet simultaneously and wherein said endless belt transport device is positioned to transport said receiving sheet from said image member to said fixing means.

15. Method of forming duplex toner images on a receiving sheet, said method comprising:

forming first and second toner images on an image member, transferring said first toner image from said image member to a first intermediate member, transferring said first toner image from said first intermediate member to a second intermediate member, transferring said second toner image from said image member directly to a first side of a receiving sheet, and transferring said first toner image from said second intermediate member to the other side of said receiving sheet to create a duplex toner images on said receiving sheet.

* * * * *